US005979196A

United States Patent [19]

Vanmoor

[11] Patent Number: 5,979,196

[45] Date of Patent: Nov. 9, 1999

[54] SECURITY TAG AND KEY/LATCH COMBINATION

[76] Inventor: Arthur Vanmoor, 18761 W. Dixie Hwy., North Miami Beach, Fla. 33180

[21] Appl. No.: 08/758,103

[22] Filed: Nov. 29, 1996

Related U.S. Application Data

[63] Continuation of application No. 08/508,708, Jul. 28, 1995, abandoned.

[51] Int. Cl.[6] ..... E05B 73/00

[52] U.S. Cl. ..... 70/57.1; 24/460; 24/461; 70/276; 70/387; 70/422

[58] Field of Search ..... 70/57.1, 276, 387, 70/422, 345, 351, 352, 378, DIG. 74; 24/704.1, 460, 461

[56] References Cited

U.S. PATENT DOCUMENTS

| | | | |
|---|---|---|---|
| 1,424,209 | 8/1922 | Pabst | 24/460 |
| 1,953,535 | 4/1934 | Hurd | 70/422 |
| 2,121,147 | 6/1938 | Goodrich | 24/460 |
| 2,931,607 | 4/1960 | McFarland | 24/704.1 X |
| 3,257,499 | 6/1966 | Broske | 24/460 X |
| 3,395,555 | 8/1968 | Hickman | 70/276 |
| 3,426,412 | 2/1969 | Strong et al. | 24/461 |
| 3,785,188 | 1/1974 | Drathschmidt | 70/276 |
| 3,932,918 | 1/1976 | Paskert | 70/57.1 |
| 3,967,479 | 7/1976 | Vick | 70/276 |
| 4,073,415 | 2/1978 | Pegg | 70/59 X |
| 4,184,277 | 1/1980 | Larin | 70/276 X |
| 4,570,306 | 2/1986 | Eyler | 24/704.1 X |
| 4,885,920 | 12/1989 | Larson | 70/59 X |
| 4,993,245 | 2/1991 | Ott | 24/704.1 X |

FOREIGN PATENT DOCUMENTS

| | | | |
|---|---|---|---|
| 1254134 | 8/1986 | U.S.S.R. | 70/276 |

*Primary Examiner*—Lloyd A. Gall
*Attorney, Agent, or Firm*—Herbert L. Lerner; Laurence A. Greenberg

[57] ABSTRACT

A flexible material such as garment fabric to be protected against theft is clamped into a lockable security tag. A key can be inserted into a key hole formed in the security tag for releasing the lock and to remove the tag from the garment item. The key thereby has a shape which complements a member of the cam mechanism so as to allow the cam to be operated with the key. A given decoupler is matched to a given batch of security tags, and the given decoupler is not matched to another, different batch of security tags. A certain store, therefore, has a matched decoupler for its tags while another store has a different decoupler which is matched to a different batch. The decoupler is preferably a key. The security tag is thereby provided with a number of pins or prongs which break or bend back if an incorrect key is inserted or if someone attempts to pick the lock.

7 Claims, 2 Drawing Sheets

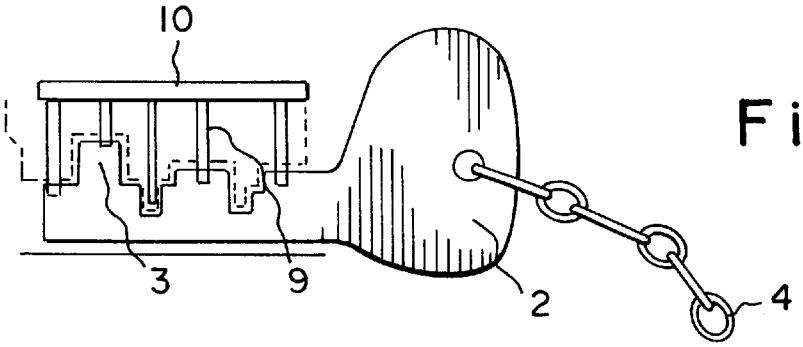
Fig. 6
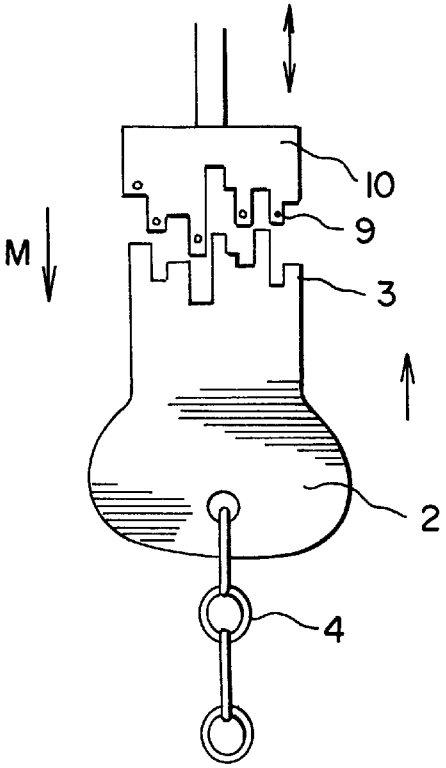
Fig. 7
Fig. 8
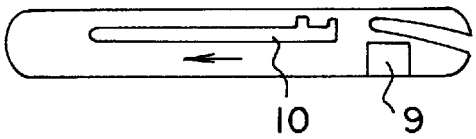
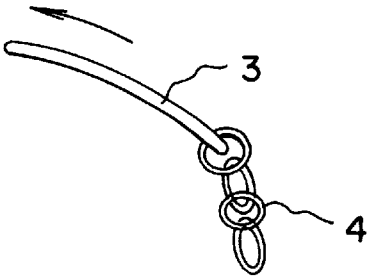
Fig. 9

SECURITY TAG AND KEY/LATCH COMBINATION

CROSS-REFERENCE TO RELATED APPLICATION

This application is a continuation of application Ser. No. 08/508,708, filed on Jul. 28, 1995, now abandoned.

BACKGROUND OF THE INVENTION

1. Field of the Invention

The invention relates to security tags which are attached to merchandise so as to prevent the merchandise from being unlawfully removed from the store.

Prior art security tags for the protection of garments and the like against shoplifting are all designed that they can be opened relatively easily by means of a certain device. This device is usually installed at a store register where it can be operated by the clerk. Such prior art decouplers are either handheld or they are stationarily disposed.

There exist several drawbacks with the existing decouplers. For instance, they are quite expensive, i.e. approximately $150.00 to $3,000.00 for air pressure decouplers and, towards the low end, magnet decouplers with a single neodymium magnet. For a store with, say, 40 registers and where only part of the store is clothing or where only part of the clothing is protected, this is a sizeable investment. Another drawback is that anyone can buy these decouplers, which means anyone can open any "security" tag. Logically, then, the purpose of the security tag is defeated when it is opened without being accompanied by a registered sale.

SUMMARY OF THE INVENTION

It is accordingly an object of the invention to provide a security tag and key, which overcomes the above-mentioned disadvantages of the heretofore-known devices and methods of this general type and which provides for more dependable protection of merchandise against theft.

With the foregoing and other objects in view there is provided, in accordance with the invention, a lockable security tag assembly, comprising: a main tag body having an undercut groove formed therein; an insertion member having a shape complementary to the undercut groove for insertion into the undercut groove; the main tag body and the insertion member defining a space therebetween for clamping and locking therein a flexible material; and a latch member formed on one of the main tag body and the insertion member and a complementary cam member disposed in the other of the main tag body and the insertion member for selectively locking the insertion member in the main tag body.

In accordance with an added feature of the invention, the main tag body has a key hole formed therein, and including a key to be inserted into the key hole, the cam mechanism and the key having mutually complementary shapes so as to allow the cam to be operated with the key.

In accordance with an additional feature of the invention, the cam mechanism includes a pin member carrying a given number of pins, and the cam mechanism can be operated only with a given minimum force, each of the given number of pins being rated to withstand a partial force such that a sum of all of the partial forces of all of the pins exceeds the minimum force and such that, if fewer than the given number of pins are engaged with the key, the cam mechanism cannot be operated.

In accordance with an alternative further feature of the invention, the pins are magnetic pins, the key is magnetic with a polarity opposite the pins, and each of the given number of pins is attracted to the key with a partial magnetic force such that a sum of each of the partial magnetic forces at least slightly exceeds the given minimum force with which the cam mechanism can be operated.

With the foregoing and other objects in view there is also provided, in accordance with the invention, a key and latch member combination, comprising: a key having a plurality of bards, a latch member to be engaged and operated by the plurality of bards and to be displaced for actuating a lock, the latch member having a given resistance against being displaced, and the latch member carrying a plurality of pins, each of the pins being rated to withstand a given partial force such that a sum of the given partial forces of the plurality of pins exceeds the given resistance.

In accordance with yet a further feature of the invention, the given partial forces are magnetic forces defined between the bards of the key and the pins of the latch member.

In other words, the object is solved by making it more difficult to remove the protective security tags, in that the security tags are better secured on the garments or other goods to be protected against theft.

In contrast with the conventional prior art systems, the decouplers of this invention are not universal. Each customer or chain of stores receives their own decoupler, and tags that can only be opened by way of that decoupler. This can be achieved by changing the size and/or the shape of the security tag so that it can only fit in a certain decoupler. For instance, each set of matching tags and decouplers is unique and only the manufacturer or the distributor maintains the necessary information on a secret level. While one customer receives tags and decouplers of a certain size, the next customer receives tags and decouplers of a different size or shape.

In practicality this can be achieved by providing a certain pattern of ridges and/or slots on the outside diameter of the tag and a complementary pattern in the decoupler.

In a more advanced embodiment, the decoupler is a lightweight tool, such as a key, replacing the conventional bulky and expensive device. That tool is inserted into an opening provided in the tag body and it may be attached to a strong chain attached at a register desk. The insertion tool, in a preferred embodiment of the invention, looks similar to an ordinary house key. In another embodiment it is a magnetic key or electronic key.

Due to the fact that a mechanical key and lock combination of metal is too heavy for a security tag, the assembly according to the invention is formed of plastic. Preferably, the tag and the key are formed of the same material, i.e. conventional PVC type plastic. It is important, however, not to simply copy known lock mechanisms and to form a plastic version thereof. Such a configuration would result in problems. For instance, a thief could stick in a screwdriver and twist and break the cylinder pins. Also, conventional locks are generally quite easily picked by experienced thieves and locksmiths.

The instant invention proceeds yet a step further in that a lock is disclosed which cannot be picked. In fact, a relatively simple modification of prior art cylinder lock systems leads to a substantially improved lock and key system which is extremely safe.

Other features which are considered as characteristic for the invention are set forth in the appended claims.

Although the invention is illustrated and described herein as embodied in a security tag and key, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 6 is a side-elevational view of a key interacting with resilient pins or prongs;

FIG. 7 is a plan view of a combination of a key and a pin member carrying locking pins;

FIG. 8 is a diagrammatic side-elevational view illustrating a rounded key hole; and FIG. 9 is a side-elevational view of a matching rounded key.

DESCRIPTION OF THE PREFERRED EMBODIMENTS

Figure 1:
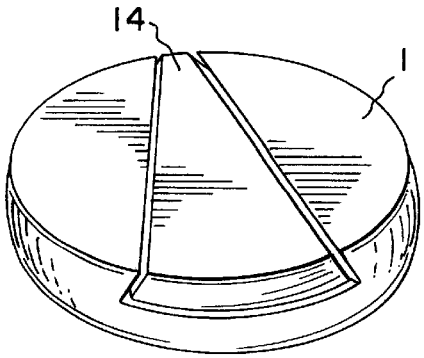
FIG. 1 is a perspective view of a security tag with a wedge-shaped insertion member.

Referring now to the figures of the drawing in detail and first, particularly, to FIG. 1 thereof, there is seen a round security tag 1. The tag 1 may be any conventional tag which is coded so as to be detected when it is moved through a security gate. Any merchandise with the tag attached thereto cannot be taken from the store. More particularly, the security tag 1 is formed with an undercut groove and a wedge member 14 is inserted in the groove. Due to the undercut and the corresponding pyramidic shape (as seen in section transversely to the insertion direction) of the wedge, the latter is retained in the groove. Flexible material 17 such as fabric may be clamped in between the groove and the wedge member 14. As will be described in the following, the wedge member 14 is locked in its position in the groove by a nose formed thereon and a locking cam disposed in the main tag body. Additional information with regard to the wedge member and the tag body may be found in my copending application Ser. No. 08/378,381, filed Jan. 6, 1995 (international PCT publication WO 94/01646).

It should be understood that, while the exemplary embodiment is described with a wedge-shaped insertion member 14 and a corresponding opening formed in the main tag body 1, the clamping insertion part may take any other shapes as well. The important functional locking features of the tag are found in the undercut of the groove in the main tag body and its interaction with the shape of the insertion body 14 (locking against lifting the insertion body from the main tag body 1 perpendicularly to the insertion direction), together with an actuatable locking mechanism (locking against sliding the insertion body in or against the insertion direction).

A matching key is formed with a key body 2 and a certain number of bards 3. The key body 2 may be safely attached to the register desk or the like by means of a chain 4. The key coding is reflected in the configuration of the bards 3. This is similar to conventional cylinder locks.

The essential point of departure of the instant invention as compared to prior art locks is found in the force interaction between the key bards 3 and lock pins 9. As the key 2 is inserted into a key slot 6, the bards 3 impinge on the lock pins 9 and push a pin member 10 in an opening direction 11. This, in turn, causes a cam 12 to be pivoted counter-clockwise into an open position indicated in dashed lines. This frees a latch 13 (a lock nose 13) from the locking surface of the cam 12 and, accordingly, a wedge-shaped member 14 is freed to slide out of the main tag 1. An additional latch 15 is provided for thinner fabric, for instance. In that case, the wedge member 14 is slid deeper into the wedge opening, such that the locking surface on the cam 12 engages the latch 15 instead of the latch 13. The latches may also be referred to as locking protrusions. They are preferably rounded so as not to damage the resilient material as it is clamped in between the tag body 1 and the insertion member 14.

Figure 4:
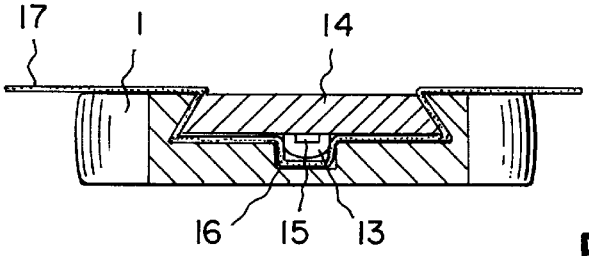
FIG. 4 is a sectional view taken along the line IV—IV in FIG. 3.

With reference to FIG. 4, the latches 13 and 15 are integrally formed on the wedge member 14 and they protrude into a corresponding slide groove 16 in the wedge opening of the tag 1.

Figure 5:
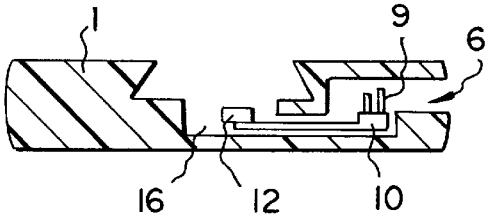
FIG. 5 is a sectional view taken along the line V—V in FIG. 5.

With reference to FIG. 5, the cam 12 together with the pin member 10 have a given resistance against being displaced towards the left. That resistance may be accurately adjusted by a separate member, such as a counter-acting spring, or by the material of the cam itself. The pins 9, on the other hand, are rated to withstand only a certain force applied thereagainst by the bards.

If, for instance, the resistive force of the cam 12 and the pin member 10 against displacement is taken as 100%, each of the pins 9 must be rated so that the totality of the pins 9 are able to be pushed with at least that 100%. If all the pins 9 are equally rated, and the number of pins is 5, then each of the pins should be rated just above 20%. Full security of the lock is attained, if each of the pins 9 can withstand a maximum of 24%. Accordingly, if the wrong key is inserted, or if a thief attempts to break the lock, it is extremely unlikely that each of the pins is subjected to the correct amount of force (towards the left in FIGS. 3 and 5).

It is thereby possible to configure the pins 9 such that they break off if a force of more than 24% (in the five-pin example) of the total 100% force is applied thereon. The lock is thus rendered useless and it must be otherwise broken and disposed off. This embodiment is suitable for low-cost items, such as shirts and the like. Another embodiment provides the pins 9 with enough resilience, so as to allow them to resiliently yield instead of breaking. Again, the lock cannot be opened, unless a force is applied on each of the pins which is between its minimum share and its maximum rating (20% and 24%, respectively, in the five-pin embodiment). In other words, in the first embodiment only one attempt can be made to pick the lock or try to open with the wrong key. It depends on the use of lock and/or tag which option is preferable.

Figure 2:
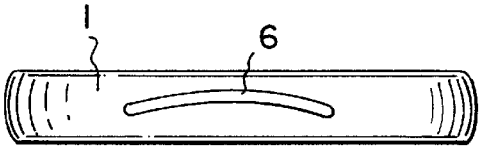
FIG. 2 is a side-elevational view thereof showing the tag body with a key hole.

Any number of shapes is possible with regard to the key and the associated insertion opening. The teeth, i.e. the bards, can be regular or as seen in FIG. 2. It is possible to provide a push-key, as in the embodiment of FIGS. 3–5, or a conventional rotating or pivoting key, as illustrated in FIG. 6. The former lock may thus be opened by simply inserting the key, and the latter requires insertion and rotation.

Figure 3:
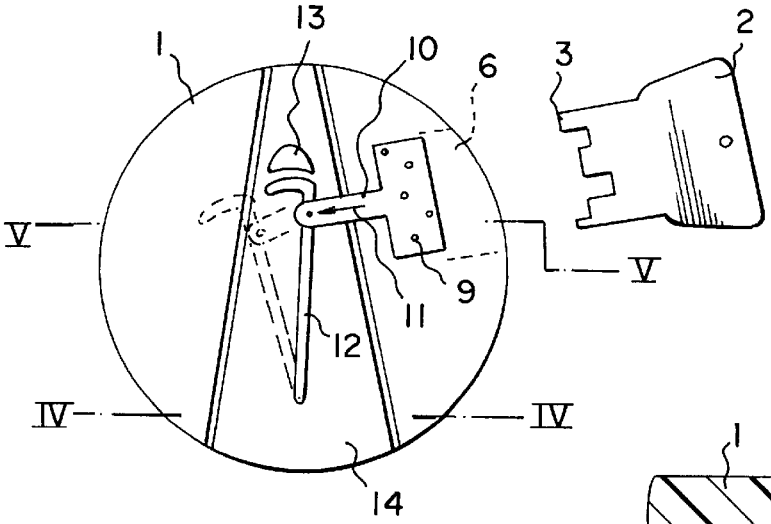
FIG. 3 is a plan view thereof indicating the individual members in an X-ray view.

In a further embodiment of the invention, as particularly exemplified in FIG. 7, the pin member 10 and the pins 9 disposed thereon are permanently magnetic and the key bards are also magnetic with the opposite polarity. When the key 2 approaches the pins 9, the key bards 3 are attracted to the pins 9 and it is possible to pull the pin member 10, and thus the locking cam 12, from the locking position. The force of the magnetic attraction m between the pins 9 and the key bards 3 is rated such that the locking cam 12 can only be unlocked if all of the pins 9 are engaged with a corresponding bard 3. In the embodiment of FIG. 3, the magnetic embodiment would thus be provided with an unlocking direction 11 opposite to the arrow shown. In that case it is also possible to provide the insertion member 14 with several latches 15 and 13, because the cam 12 is pivoted in the clockwise direction when the lock is opened.

It should be understood that the foregoing description of the preferred embodiment and the specific application of the system to security tags does in no way limit the broader applicability of the lock system as described above.

I claim:

1. lockable security tag assembly for non-destructively securing a work piece made of a flexible material, the lockable security tag assembly, comprising:

a main tag body having an undercut groove formed therein;

said undercut groove defining a wedge opening having a slide groove;

an insertion member having a shape complementary to said undercut groove for insertion into and removal from said undercut groove;

said main tag body and said insertion member defining a space therebetween for non-destructively clamping and locking therein a work piece made of a flexible material; and a latch member formed on one of said main tag body and said insertion member and a complementary cam member disposed in the other of said main tag body and said insertion member for selectively locking said insertion member in said main tag body, with said cam member and said latch member disposed inside said slide groove and the flexible material adapted to be clamped in between said cam member and said latch member.

2. The assembly according to claim 1, wherein said main tag body has a key hole formed therein, and including a key to be inserted into said key hole, said cam member and said key having mutually complementary shapes so as to allow said cam member to be operated with said key.

3. The assembly according to claim 2, wherein said cam member includes a pin member carrying a given number of pins, and said cam member can be actuated only with a given minimum force, each of said given number of pins being rated to withstand a partial force such that a sum of all of the partial forces of all of said pins exceeds said minimum force and such that, if fewer than said given number of pins are engaged with said key, said cam member cannot be actuated.

4. The assembly according to claim 2, wherein said cam member includes a pin member carrying a given number of magnetic pins, said key is magnetic with a polarity opposite said pins, and said cam member can be actuated only with a given minimum force, each of said given number of pins being attracted to said key with a partial magnetic force such that a sum of each of the partial magnetic forces at least slightly exceeds the given minimum force with which said cam member can be actuated.

5. A key and latch member combination, comprising: a key having a plurality of bards, a latch member to be displaced by said key for actuating a lock, said latch member having a given resistance against being displaced, and said latch member carrying a plurality of pins each subjectable to a given partial force by a respective one of said plurality of bards of said key, each of said pins being rated to withstand a given partial force such that a sum of the given partial forces of said plurality of pins exceeds said given resistance.

6. The combination according to claim 5, wherein the given partial forces are magnetic forces defined between said bards of said key and said pins of said latch member.

7. The combination according to claim 5, wherein said key is matched to a given batch of a multiplicity of security tags of a given type, and said key is not matched to another, different batch of a multiplicity of security tags of the given type.

* * * * *